United States Patent [19]

Hults

[11] 4,061,895

[45] Dec. 6, 1977

[54] HIGHER RATED DOUBLE-POLE TRIGGER SWITCH

[75] Inventor: Harold W. Hults, New Berlin, Wis.

[73] Assignee: Cutler-Hammer, Inc., Milwaukee, Wis.

[21] Appl. No.: 651,171

[22] Filed: Jan. 21, 1976

[51] Int. Cl.[2] ..... H01H 9/06; H01H 13/08

[52] U.S. Cl. ..... 200/157; 200/77; 200/153 K

[58] Field of Search ..... 200/77, 153 K, 153 LA, 200/157, 166 BF; 318/249

[56] References Cited

U.S. PATENT DOCUMENTS

| | | | |
|---|---|---|---|
| 3,225,156 | 12/1965 | Sahrbacker | 200/153 K X |
| 3,348,010 | 10/1967 | Johnson | 200/157 |
| 3,591,747 | 7/1971 | Dennison | 200/153 K |
| 3,775,576 | 11/1973 | Brown | 200/157 |
| 3,869,590 | 3/1975 | Hults | 200/157 |
| 3,936,708 | 2/1976 | Dummer | 318/249 |

*Primary Examiner*—Volodymyr Y. Mayewsky
*Attorney, Agent, or Firm*—Hugh R. Rather; William A. Autio; Michael E. Taken

[57] ABSTRACT

A multipurpose electric trigger switch adapted to be mounted in the handle of a portable electric tool for controlling the A. C. power circuit and, to afford a higher rating, the switch is provided with double-pole butt contacts. A movable contactor is pivoted and translated on a resilient terminal into wiping and abutting contact with a stationary terminal in response to linear sliding movement of an operator having a cam which engages inclined camming surfaces on the contactor.

23 Claims, 5 Drawing Figures

HIGHER RATED DOUBLE-POLE TRIGGER SWITCH

BACKGROUND OF THE INVENTION

Electric switches, including trigger switches for portable electric tools, have been known heretofore. However, these prior switches have been subject to one or more disadvantages that have limited their electrical capabilities, such as sliding contacts subject to excessive wear that limits the life of the switch, contacts that are teasible and contact operating mechanisms that reduce contact pressures prior to opening thereby causing early deterioration, and short trigger movement between contact closed and open positions that causes frequent or false operation and might create dangerous conditions particularly when used in portable electric circular saws and the like. While my prior U.S. Pat. No. 3,869,590, issued Mar. 4, 1975 and my pending application Ser. No. 586,059, filed June 11, 1975, disclose switch structures that overcome these disadvantages, this invention relates to an alternative structure for accomplishing the same.

SUMMARY OF THE INVENTION

This invention relates to electric switches, including double-pole higher rated tool handle switches of the trigger operated type.

An object of the invention is to provide an improved switch.

Another object of the invention is to provide an improved higher rated switch.

A more specific object of the invention is to provide an improved butt contact switch which will positively shear and break any contact welds.

Another specific object of the invention is to provide an improved switch of the aforementioned type having non-teasible contacts.

Another specific object of the invention is to provide an improved switch of the aforementioned type having a controllable amount of wipe.

Another specific object of the invention is to provide an improved switch of the aforementioned type having low contact bounce.

Another specific object of the invention is to provide an improved switch of the aforementioned type having maximum contact pressure at the point of trip open.

Another specific object of the invention is to provide an improved switch of the aforementioned type having substantial trigger movement between trip "off" and trip "on" positions to prevent repeated or accidental switch operation.

Another specific object of the invention is to provide an economical and reliable higher rating contact mechanism for an electric switch.

Other objects and advantages of the invention will hereinafter appear.

DESCRIPTION OF THE PREFERRED EMBODIMENT

Figure 1:
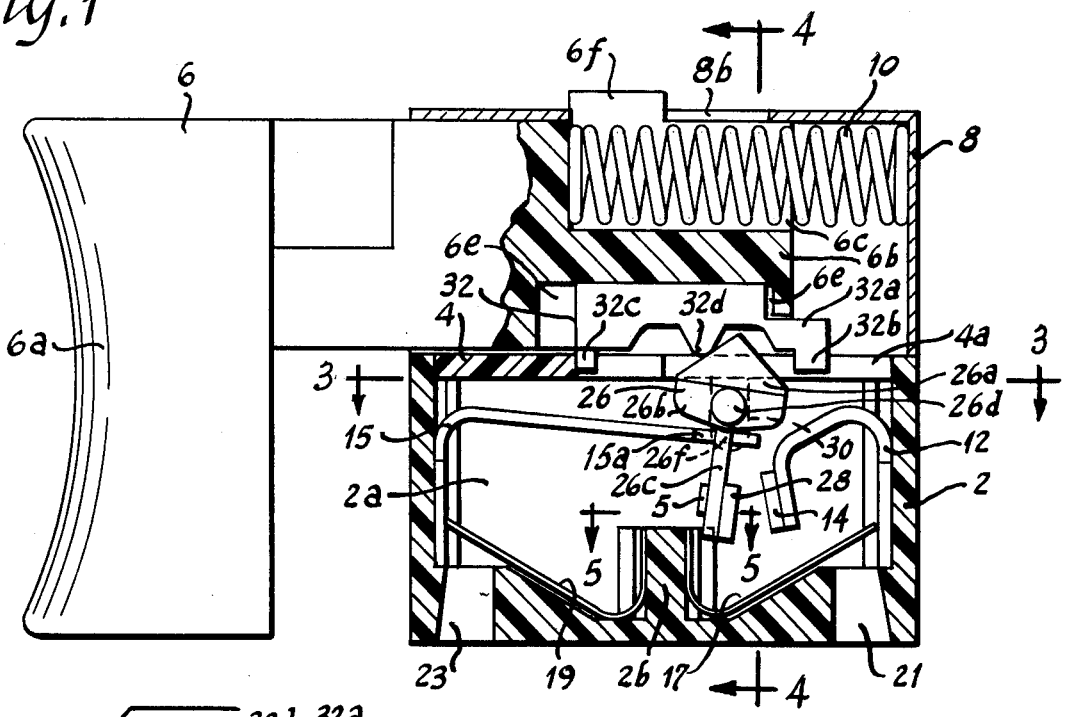
FIG. 1 is an enlarged partial, vertical cross-sectional view of the switch taken along line 1—1 of FIG. 3 to show one pole of the two pole electric switch.

Referring to the drawings, there is shown a double-pole higher rated tool handle switch constructed in accordance with the invention. By higher rated is meant that for an electrical rating of 12 amperes, 125 volts, having an inrush current of 60 amperes on make and current of 12 amperes on break, for example, it will have an operational life rating of 50,000 to 60,000 operations, an increase of 4 to 5 times over prior lower rated switches in the same size of housing.

Figure 2:
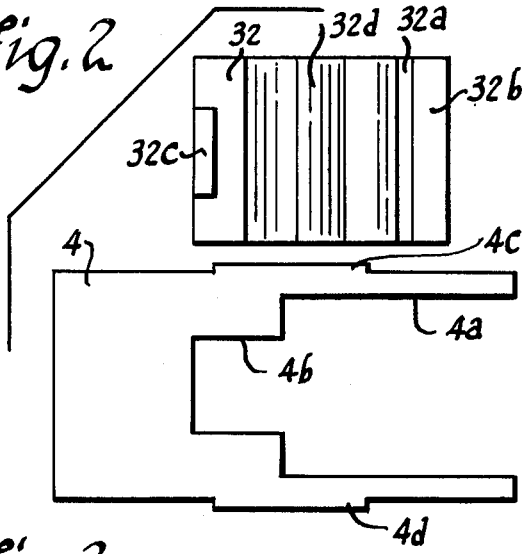
FIG. 2 is a bottom view of the camming insert and the insulating base cover in disassembled condition.
Figure 4:
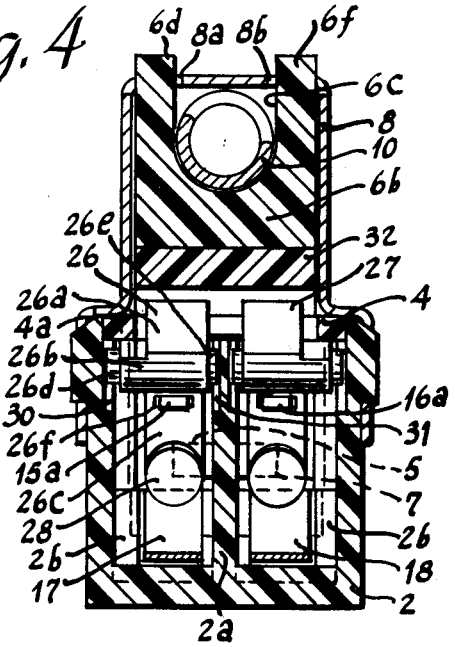
FIG. 4 is a vertical cross-sectional view taken along line 4—4 of FIG. 1 to show a rear view of the contactors.
Figure 3:
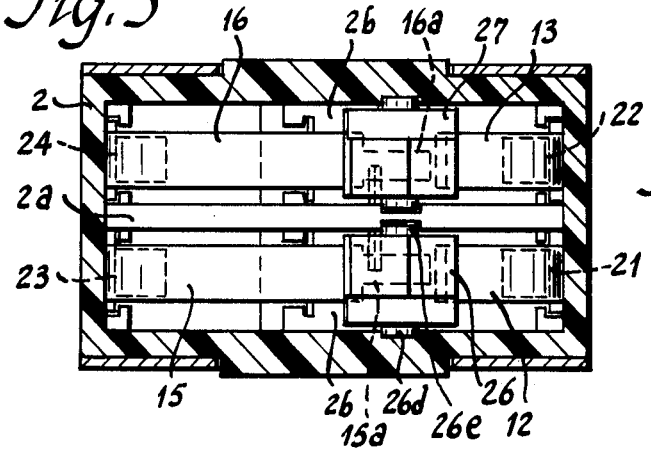
FIG. 3 is a horizontal cross-sectional view taken generally along line 3—3 of FIG. 1 to show a top view of the double-pole contacts.

As shown in FIGS. 1 and 3, the switch is provided with an insulating base 2 generally rectangular in shape and open at the top for housing the double-pole switch contacts, the left pole of which is shown in FIG. 1. The top of this base is partly closed by an insulating cover 4, as shown in FIG. 1. As shown in FIG. 2, this cover is provided with a slot **4*b* rearwardly opening into a wider slot 4*a*, the purpose of which is described more fully hereinafter. This cover is also provided with elongated narrow locating ears 4*c* and 4*d* protruding from the sides thereof to seat the cover in complementally formed notches in the base 2, as shown in FIGS. 2 and 4. The interior of the base is divided into two compartments, left and right, for the respective poles of the double-pole switch, by a longitudinal center dividing wall 2*a*, FIG. 4, that extends all the way up to cover 4. These left and right compartments are each divided into two subcompartments, front and back, for the movable and stationary contact connector clips, by a lateral wall 2*b*, FIG. 1, extending across the middle thereof. Each back subcompartment is provided with a stop or boss 5 and 7 extending laterally from center dividing wall 2*a* of the base to limit the clockwise pivoting of movable contactors 26 and 27**, as will be more fully described hereinafter.

An insulating trigger 6 has a finger-engaging portion **6*a* extending forwardly from the base and a slidable portion 6*b* overlying the base and held thereon by a frame 8 that is secured to the base in a known manner. A trigger return spring provides the switch with momentary action. For this purpose, a helical compression spring 10 is positioned in a groove 6*c* that extends forwardly partway from the rear end of slidable portion 6*b* of the trigger. The front end of this spring bears against the vertical wall at the front end of such groove and the rear end of this spring bears against the rear vertical wall of the frame. To limit trigger movement in both directions, the frame is provided with a pair of rectangular apertures 8*a* and 8*b* and the top of the slidable portion of the trigger is provided with a pair of projections 6*d* and 6*f* extending up through the respective apertures for limited movement therein as shown in FIGS. 1 and 4**.

Left and right stationary contact terminals 12 and 13 are retained in slots in the rear end of base 2, FIGS. 1 and 3. These rigid terminals extend from their anchored ends up, then down and toward the front, and then down and slightly toward the rear, as shown in FIG. 1. A stationary contact 14 is affixed to terminal 12 and another stationary contact (not shown) is affixed to terminal 13. Left and right flexible cantilever terminals 15 and 16 are retained in slots in the front end of base 2, FIGS. 1 and 3. These flexible terminals extend from their anchored ends up then toward the rear, reduced rear end portions 14*a* and 16*a*, FIGS. 1, 3 and 4, passing through rectangular apertures in the shank portions of the respective contactors 26 and 27 to bias the contactors upwardly, as will be more fully described hereinafter.

Figure 5:
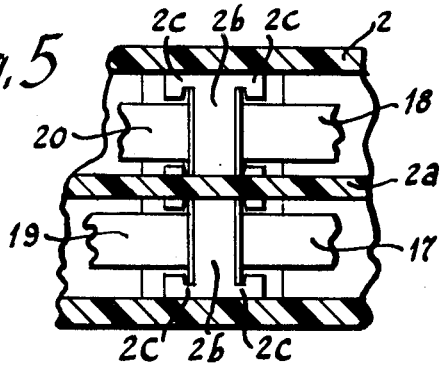
FIG. 5 is a partial, horizontal cross-sectional view taken along line 5—5 of FIG. 1 to show the wire retention clips.

In order to make electrical connections to the two pairs of terminals of the double-pole switch, there are provided a first pair of connector clips 17 and 18 at the rear bottom of the base, and a second pair of connector clips 19 and 20 at the forward bottom of the base, as shown in FIGS. 1 and 5. These clips are formed alike from a ribbon-like metal strip and each is provided with a pair of short wings at the vertical mounted end thereof adjacent lateral wall 2*b* of the base whereby they are retained in a pair of vertical grooves 2*c* in the wall as shown in FIG. 5. From the lower end of such vertical retaining portion, each connector clip is bent up about 30° from the horizontal so that the other end thereof rests against the flat inner surface of the retaining portion of the respective terminal. The bottom of the base is provided with two pairs of holes 21, 22 and 23, 24, FIGS. 1 and 3, through which solid or tinned, stranded electric wires may be pushed in between the terminals and the respective connector clips to make connections thereto.

Each flexible terminal 15 and 16 carries a movable contactor 26 and 27 respectively. Contactor 26 has: an upper, molded insulating portion 26*a* having two oppositely inclined camming surfaces meeting at an apex; an enlarged middle, insulating portion 26*b* having trunnions 26*d* and 26*e* formed on the lateral ends thereof; and a depending electrically conductive shank portion 26*c* having a terminal-receiving rectangular aperture 26*f* and a contact 28 attached to one surface of its lower end. Contactor 27 is identically formed and has a contact 29 mounted thereon. As aforedescribed, and shown in FIGS. 1, 3 and 4, the reduced end portion 15*a* of flexible terminal 15 extends through aperture 26*f*, in electrical connection with shank portion 26*c* and biases the contactor upwardly. Trunnions 26*d* and 26*e* ride up and down in slots 30 and 31, FIGS. 1 and 4, formed in the base side wall and center dividing wall, thereby permitting pivoting of the contactor together with vertical reciprocal motion thereof. Likewise, contactor 27 pivots and reciprocates vertically in the right compartment of the base.

As seen in FIG. 1, the trigger is formed with recess 6*e* for slidably receiving a single cam insert 32. This insert extends across the width of frame 8, as shown in FIG. 4, and has a rear portion 32*a* extending rearwardly beyond the recess and a lower rear portion 32*b* extending downwardly therefrom through slot 4*a* in the cover, FIGS. 1 and 2. Portion 32*b* is spaced slightly above center dividing wall 2*a*. A lower front portion 32*c*, FIGS. 1 and 2, extends downwardly from the center of the insert through slot 4*b*. The front edge of slot 4*b* and the rear wall of base 2 act as stops for the forward-rearward sliding of the insert. The insert is further provided with a camming tip 32*d* formed on its bottom surface by a pair of spaced lateral grooves for engaging the inclined camming surfaces of both contactors 26 and 27.

Operation of the switch will now be described. FIG. 1 depicts full trigger release with projections 6*d*, 6*f* stopped against the front edge of apertures 8*a*, 8*b* and with lower portion 32*c* stopped against the front edge of slot 4*b*. Upon depression of the trigger, against the bias of spring 10, the insert will remain stationary until the front vertical wall of recess 6*e* strikes the front of insert 32, thus resulting in lost motion of the trigger to thereby increase trigger movement between trip "off" and trip "on" positions. Further depression of the trigger will carry the insert with it to cause downward camming of the contactors. When camming tip 32*d* crosses the apex formed by the two inclined camming surfaces of contactor 26, the contactor will suddenly pivot counterclockwise about trunnions 26*d* and 26*e* to close contacts 28 and 14. Contactor 27 likewise pivots to close the contacts in the right compartment. The insert snaps rearwardly, allowing upward movement of the contactor which causes wiping action of the contacts as they engage. Upon trigger release, the insert remains stationary and stopped against the rear wall of base 2 until the rear wall of recess 6*e* strikes the upper rear part of the insert. Further release of the trigger carries the insert forwardly with it to cause downward movement of the contactor which shears and breaks any welds between the contacts as they disengage when the tip 32*d* passes over the apex.

It is important to provide a forward stop for insert 32 so that camming tip 32*d* can provide an upward stop for the contactors under the bias of the flexible terminals, thus effecting a clockwise torque on the contactors against stops 5 and 7 respectively. After the camming tip passes the apex, the upward bias of the flexible terminal produces a counterclockwise torque on the contactor because the upward stop (camming tip 32*d*) is now on the negatively sloped rear camming surface and because the contactor cannot move horizontally.

It is also important to provide a rearward stop for insert 32 so that camming tip 32*d* can remain an upward stop for the contactor when the trigger is fully depressed and the contacts are closed. These stops and the horizontal constrainment provided by slots 30 and 31 in the walls of the base enable the upward bias of the flexible terminal to produce the requisitely directed torque to pivot the contactor.

While a trigger switch has been shown, it can easily be appreciated the mechanism disclosed hereby is adaptable for use in other types of switches. For example, sliding portion 6*b* may be horizontally reciprocated by a toggle lever cooperating therewith from above.

The objects of the invention are achieved in the following respects:

there is positive shearing and breaking of any welds because of the pivoting and vertically downward motion of the contactor during trigger release;

the contacts are non-teasible because the camming tip cannot be held on the apex of the contactor;

the amount of wipe is controlled by the flexure of the flexible terminal, the slope of the inclined camming surfaces of the contactor, and the vertical depth of the camming tip;

there is low contact bounce because of the continuous counterclockwise torque applied to the contactor by the upward bias of the flexible terminal after the camming tip crosses the apex;

there is maximum contact pressure at the point of trip open because the contactor is cammed to its extreme downward position against the bias of the flexible terminal at such point;

there is substantial trigger movement between trip "on" and trip "off" positions due to the lost motion of the camming insert within recess 6e and the distance across an inclined surface which the camming tip must traverse before reaching the apex.

I claim:

1. A double-pole tool handle switch comprising:

an electrically insulating housing;

a pair of stationary contacts mounted in said housing;

a pair of identical adjacent contactors each having:

(1) a middle portion mounting the same to said housing for pivotal and vertical movement therein;

(2) a lower portion carrying a movable contact for engaging the respective stationary contact in one direction of pivoting of said contactor and for disengaging said respective stationary contact in another direction of pivoting of said contactor; and (3) an upper portion having a pair of oppositely inclined camming surfaces forming an apex at their junction;

limiting means in said housing limiting the pivoting of each contactor in said other direction;

a pair of resilient cantilever terminals in electrical engagement with respective contactors, each terminal having one end mounted to said housing and the other end biasing the respective contactor upwardly;

an operator slidably mounted to said housing;

cam means slidably mounted to said operator for limited motion therealong between first and second limited positions relative thereto and arranged to engage said camming surfaces of said contactors; and stop means in said housing for limiting the movement of said cam means relative thereto between forward and rearward positions such that said cam means is continuously in engagement with camming surfaces of said contactors to stop the upward movement thereof thereby effecting a torque on said contactors about said middle portions;

such that during operation of said operator said cam means slides along said operator to said first limited position, after which said cam means is carried by said operator and slides across one of said inclined surfaces of each contactor causing downward movement of said contactors until said cam crosses said apex of each contactor, after which a reverse torque pivots the contactors to close said contacts and the contactors move upwardly as said cam means slides across the other of said inclined surfaces of each contactor to provide contact wiping, said cam means simultaneously sliding along said operator to said rearward position relative to said housing, and such that during return operation of said operator said cam means slides along said operator to said second limited position, after which said cam means is carried by said operator and slides across said other of said inclined surfaces of each contactor causing downward movement of said contactors to shear any welds formed between said contacts until said cam means crosses said apex of each contactor, after which said contactors pivot to open said contacts and move upwardly as said cam means slides across said one of said inclined surfaces of each contactor, said cam means simultaneously sliding along said operator to said forward position relative to said housing.

2. The invention defined in claim 1 wherein said cam means moves horizontally with respect to said housing.

3. The invention defined in claim 2 wherein said operator comprises a return spring biased trigger horizontally movable with respect to said housing.

4. The invention defined in claim 3 wherein said cam means comprises a cam insert received within a downwardly opening recess in said trigger, said recess having a greater horizontal length than said cam insert, and wherein said cam insert has a downwardly projecting camming tip for engaging said inclined surfaces of each of said contactors.

5. The invention defined in claim 1 wherein each of said contactors comprises an integral generally T-shaped member with a pointed top and wherein said middle portion has a trunnion extending from each side thereof into vertical grooves in said housing and wherein said lower portion comprises a shank-like member extending downwardly from said middle portion and carrying said movable contact near the bottom thereof and has an aperture formed near the top thereof for receiving said other end of the respective cantilever terminal.

6. The invention defined in claim 1 wherein said housing comprises a center wall dividing the housing into two compartments, each compartment having its own stationary contact, contactor, cantilever terminal and limiting means.

7. The invention defined in claim 1 wherein said housing comprises a U-shaped horizontal cover member wherein the bight of said U-shaped member extends between said operator and said cantilever terminals and wherein said upper portion of each of said contactors extends between the legs of said U-shaped member.

8. The invention defined in claim 4 wherein said cam insert has downwardly extending front and rear projections engaging said stop means in said forward and said rearward positions, respectively.

9. The invention defined in claim 8 wherein said stop means comprises a rear vertical wall of said housing for engaging said rear projection and a flat horizontal cover member having a vertical wall mounted in said housing and having a vertical wall for engaging said front projection.

10. The invention defined in claim 1 wherein said apex affords an unstable position of said cam means, whereby to provide non-teasibility of said contacts.

11. The invention defined in claim 4 wherein the amount of said contact wiping is controlled by the flexure of said resilient cantilever terminals, the slope of said inclined camming surfaces, and the vertical depth of said camming tip.

12. The invention defined in claim 1 providing minimum contact bounce due to the continuous said reverse torque applied to said contactors by said upward bias of said resilient cantilever terminals after said camming means crosses said apex.

13. The invention defined in claim 1 wherein said contactors are cammed to their extreme downward position against said bias of said resilient cantilever terminals immediately prior to said crossing of said apex during said return operation whereby to afford maximum contact pressure immediately prior to said opening of said contacts.

14. The invention defined in claim 4 wherein said recess together with said camming surface provide lost motion of said trigger whereby to increase trigger movement between said contact opening and closing positions.

15. An electric switch comprising:

an electrically insulating housing;

a stationary contact mounted in said housing;

a contactor having: (1) a middle portion mounting the same to said housing for pivotal and vertical movement therein; (2) a lower portion carrying a movable contact for buttingly engaging said stationary contact in one direction of pivoting of said contactor and for disengaging said stationary contact in another direction of pivoting of said contactor, said vertical movement of said contactor providing wiping action between said contacts when engaged; and (3) an upper portion having inclined camming surfaces meeting at the top of said upper portion;

limiting means in said housing limiting the pivoting of said contactor in said other direction;

biasing means in said housing biasing said contactor upwardly;

operator means movably mounted to said housing and having a cam traversible across said top of said upper portion of said contactor and engaging said camming surfaces to stop the upwardly biased movement of said contactor to effect a torque on said contactor about said middle portion due to the upward bias of said biasing means;

such that in response to movement of said operator means said cam slides along one of said inclined camming surfaces towards said top causing downward movement of said contactor until said cam crosses said top, after which said torque is reversed to pivot said contactor in said one direction to close said contacts in butting engagement and said contactor moves upwardly under the bias of said biasing means as said cam slides along another of said inclined camming surfaces away from said top to thereby provide wiping of said contacts; and such that in response to return movement of said operator means said cam slides along said other inclined camming surface towards said top causing downward movement of said contactor to shear welds formed between said contacts until said cam crosses said top, after which said torque is again reversed to pivot said contactor in said other direction to open said contacts and said contactor moves upwardly under the bias of said biasing means as said cam slides along said one inclined camming surface away from said top.

16. The switch according to claim 15 wherein said biasing means comprises a resilient cantilever mounted at one end to said housing and having its other end adjacent said contactor to bias the same upwardly.

17. The switch according to claim 15 wherein said cam is slidably mounted to said operator for limited movement.

18. The switch according to claim 15 wherein said cam moves horizontally with respect to said housing.

19. The switch according to claim 18 wherein said operator means comprises a return spring biased trigger horizontally movable with respect to said housing.

20. The switch according to claim 19 wherein said cam is received within a downwardly opening recess in said trigger, said recess having a greater horizontal length than said cam.

21. The switch according to claim 15 wherein said contactor comprises an integral generally T-shaped member with a pointed top and wherein said middle portion has a trunnion extending from each side thereof into vertical grooves in said housing and wherein said lower portion comprises a shank-like member extending downwardly from said middle portion and carrying said movable contact near the bottom thereof.

22. The switch according to claim 21 wherein said biasing means comprises a resilient cantilever mounted at one end to said housing and extending at the other end through an aperture formed near the top of of said shank-like member to bias said contactor upwardly.

23. The switch according to claim 15 comprising an electrically insulating housing.

* * * * *